US006756738B2

(12) United States Patent
Maede et al.

(10) Patent No.: US 6,756,738 B2
(45) Date of Patent: Jun. 29, 2004

(54) ORGANIC EL DRIVE CIRCUIT AND ORGANIC EL DISPLAY DEVICE USING THE SAME

(75) Inventors: Jun Maede, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/360,715

(22) Filed: Feb. 10, 2003

(65) Prior Publication Data

US 2003/0151374 A1 Aug. 14, 2003

(30) Foreign Application Priority Data

Feb. 12, 2002 (JP) ..... 2002-033937

(51) Int. Cl.[7] ..... G09G 3/10; G09G 5/00

(52) U.S. Cl. ..... 315/169.1; 315/169.3; 345/214; 345/213; 345/197; 345/76

(58) Field of Search ..... 315/169.1, 169.3, 315/169.2; 345/76, 78, 77, 204, 214, 197, 213

(56) References Cited

U.S. PATENT DOCUMENTS 6,545,651 B2 * 4/2003 Nishigaki et al. ..... 345/76
6,586,888 B2 7/2003 Kitahara et al. ..... 315/169.1

FOREIGN PATENT DOCUMENTS

JP 10-112391 4/1998
JP 11-45071 2/1999
JP 2003-234655 8/2003

* cited by examiner

*Primary Examiner*—Tuyet T. Vo
(74) *Attorney, Agent, or Firm*—Mattingly, Stanger, & Malur, P.C.

(57) ABSTRACT

A drive current having a peak current, for driving an organic EL display panel, is generated by generating the peak current in output side transistors of a current mirror circuit having a plurality of input side transistors by driving one of the input side transistors with a predetermined current and reducing an output current of the output side transistors from the peak current to a steady current by reducing the drive current per one input side transistor by branching the predetermined current to the other input side transistors connected in parallel to the one input side transistor.

22 Claims, 5 Drawing Sheets

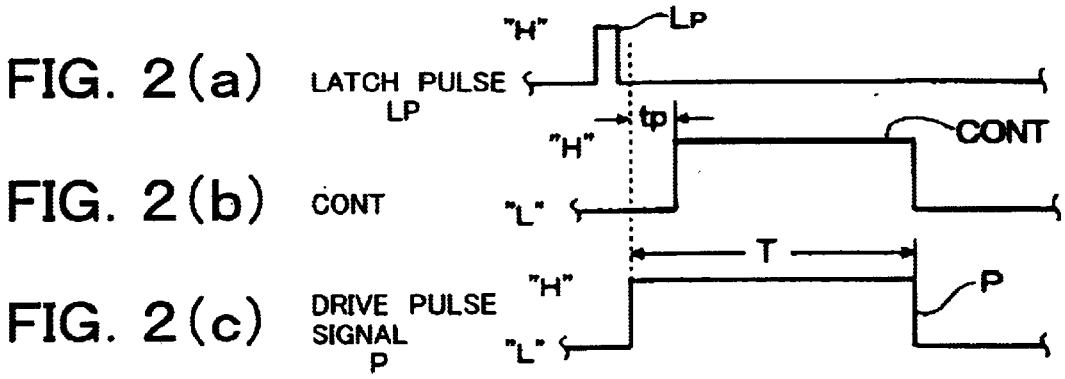
FIG. 5 PRIOR ART
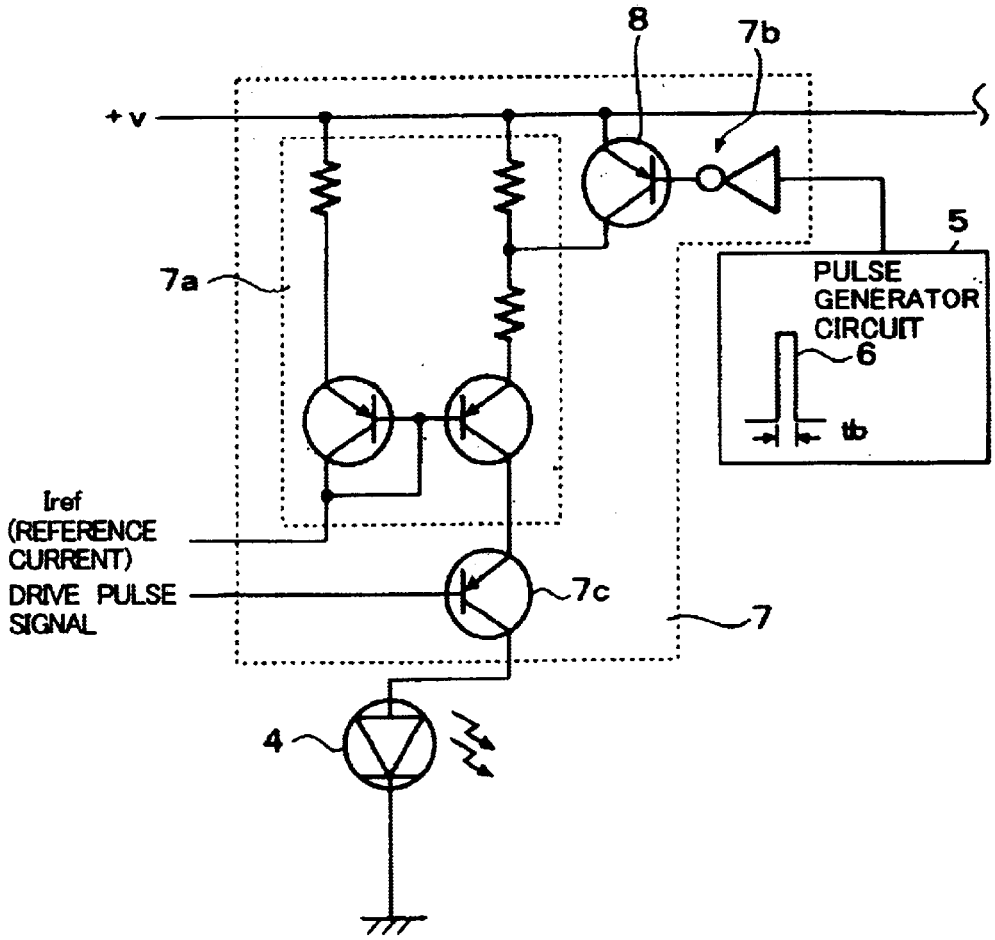

ORGANIC EL DRIVE CIRCUIT AND ORGANIC EL DISPLAY DEVICE USING THE SAME

BACKGROUND OF THE INVENTION

1. Field of the Invention

The present invention relates to an organic EL drive circuit and an organic EL display device using the same and, in particular, the present invention relates to an improvement of an organic EL drive circuit for current-driving a column line (anode side drive line) of each of organic EL elements of an organic EL panel by supplying current, which corresponds to an input digital value and is generated by a D/A converter circuit utilizing a current mirror circuit, to each of terminal pins of the organic EL panel, such that a peak current for driving the organic EL panel can be easily generated by the drive circuit and an area of the drive circuit can be reduced and an organic EL display device using the same organic EL drive circuit.

2. Description of the Prior Art

It has been known that an organic EL display device, which realizes a high luminance display by light generated by itself, is suitable for a display on a small display screen and the organic EL display device has been attracting public attention as the next generation display device to be mounted on a portable telephone set, a DVD player or a PDA (Personal Digital Assistants) such as a portable terminal device, etc.

Known problems of the organic EL display device are that, when it is driven by voltage as in a liquid crystal display device, luminance variation thereof becomes substantial and that, since there is difference in sensitivity between R (red), G (green) and B (blue), a control of luminance of a color display becomes difficult.

In view of these problems, an organic EL display device using current drive circuits has been proposed recently. For example, JPH10-112391A discloses a technique with which the luminance variation problem is solved by employing a current drive system.

An organic EL display panel of an organic EL display device for a portable telephone set, having 396 (132 3) terminal pins for column lines and 162 terminal pins for row lines has been proposed. However, there is a tendency that the number of column lines as well as row lines is further increased.

An output stage of a current drive circuit of such organic EL display panel of the active matrix type or the simple matrix type includes a current source drive circuit, such as an output circuit constructed with a current mirror circuit for each of the terminal pins. A drive stage thereof includes a parallel-driven type current mirror circuit (reference current distribution circuit) having a plurality of output side transistors for each of the terminal pins as disclosed in JP2002-82662 (domestic priority application claiming priorities of JP2001-86967 and JP2001-396219) corresponding to U.S. patent application Ser. No. 10,102,671. In the disclosed drive stage, a plurality of mirror currents are generated correspondingly to the respective terminal pins by branching a reference current generated by the parallel-driven type current mirror circuit to thereby drive the output circuits. Alternatively, the mirror currents distributed to the respective terminal pins are amplified by respective k-time current amplifier circuits, where k is an integer not smaller than 2, and the output circuits are driven with the amplified currents.

The drive stage including the k-time amplifier circuits is disclosed in JP2002-33719, in which D/A converter circuits are provided correspondingly to the respective terminal pins. In the disclosed circuit construction, the D/A converter circuit converts display data corresponding to the column side terminal pins into analog data to generate a column side drive currents simultaneously.

In this disclosed construction, a peak current is generated for initially charging an organic EL element having capacitive load characteristics to drive the organic EL element. The peak current may be generated before the drive stage as a reference current, after a D/A converter circuit as described in JP2002-33719 or in a current output stage.

FIG. 5 shows a typical example of the peak current generator circuit for an organic EL display element of an organic EL display panel, which generates the peak current in the current output stage and is disclosed in JPH11-45071A. Further, FIG. 6 shows another example, which is disclosed in JP2002-33719 and in which the peak current generator circuit is provided after the D/A converter circuit.

The example shown in FIG. 5 in which the peak current generator circuit is provided in the current output stage will be described first. In the current drive circuit shown in FIG. 5, a pulse generator circuit 5 generates a pulse signal 6 synchronized with a drive pulse and the pulse signal 6 is supplied to a switching element 8 of an initial charging circuit 7*b* provided in parallel to a load resistor of a constant current source (current mirror output circuit) 7*a* of a drive circuit 7. Upon this, the switching element 8 is turned ON and a current flows to an organic EL element 4 through the switching element 8 and a switching transistor 7*c*, which is simultaneously turned ON by the drive pulse, so that the organic EL element 4 is driven. As a result, a large current flows for a constant time from a start time of the driving, which is determined by an ON resistance of the switching element 8 and a junction capacitance of the organic EL element 4. Therefore, in the initial drive stage, the organic EL element 4 is charged rapidly, so that a luminance of the organic EL element 4 is improved and luminance variation thereof is prevented.

The peak current generator circuit shown in FIG. 6 includes a column driver 1 of an organic EL drive circuit, a D/A converter circuit 2 and a current mirror type current output circuit 3.

The current mirror type current output circuit 3 includes a drive stage current mirror circuit 3*a* and an output stage current mirror circuit 3*b*.

The drive stage current mirror circuit 3*a* is a peak current generator circuit and includes diode-connected PNP input side transistor Qs and output side transistor Qt. Emitters of these transistors are connected to an input terminal 3*c* of the output stage current mirror circuit 3*b* through a P channel MOS FET Trs and an N channel MOS FET Trt, respectively.

A collector of the input side transistor Qs is connected to an output terminal 2*b* of the D/A converter circuit 2 and a collector of the output side transistor Qt is grounded. An emitter area ratio of the transistor Qs to the transistor Qt is 1:x. Assuming that an output current of the D/A converter circuit 2 is Ia, a drive current generated at the input terminal 3*c* becomes (x+1) Ia. Therefore, the current mirror circuit 3*a* generates drive current (1+x) Ia when the transistor Trt is in ON state. The transistor Trs is a load transistor provided correspondingly to the transistor Trt and has a gate connected to GND. The transistor Trs is provided to balance a drive line. Incidentally, the transistor Trt is turned ON for a constant time in the initial stage of driving by a control signal CONT.

The current mirror circuit 3*a* drives a PNP input side transistor Qx of the output stage current mirror circuit 3*b* through PNP current mirror transistors Qu and Qw, which are provided for base current correction. As a result, current (1+x) Ia flows through the input side transistor Qx for a constant time during which the transistor Trt is turned ON to perform a peak current drive of the organic EL element. Thereafter, the drive current Ta is outputted as a normal drive current. The current (1+x) Ia and the current Ta are amplified to N times by a PNP type output side transistor Qy of the output stage current mirror circuit 3*b* and outputted to one (9) of the column side terminal pins of an organic EL panel.

Incidentally, an emitter area ratio of the transistor Qx to the transistor Qy in the output stage current mirror circuit 3*b* is 1:N and emitters of these transistors are connected to not a power source line +VDD but a power source line +Vcc having a voltage higher than that of the power source line +VDD, that is, in a range from +15V to +20V, and a collector of the output side transistor Qy is connected to the column side terminal pin 9.

Therefore, it is possible to supply the drive current N (1+x) Ia to the column side terminal pin 9 when the peak current drive is performed. Consequently, in the initial stage of the current drive, the organic EL element 4 having the capacitive load characteristics is charged rapidly by the peak current and driven thereby.

The D/A converter circuit 2 includes a diode-connected input side NPN type bipolar transistor Qa and a current I from a constant current source 14*a* is supplied to a collector of the transistor Qa through an input terminal 2*a* of the D/A converter circuit 2. The D/A converter circuit 2 further includes output side NPN bipolar transistors Qb to Qn-1, which are connected to the transistor Qa in current mirror relation and N channel MOS FET Trb to Trn-1 connected between emitters of the output side transistors Qb to Qn-1 and ground as switch circuits. Gates of the transistors Trb to Trn-1 are connected to respective input terminals D0 to Dn-1.

Collectors of the output side transistors Qb to Qn-1 are connected to an output terminal 2*b* and emitter area ratios of the transistors Qb to Qn-1 with respect to an emitter area of the transistor Qa correspond to weights 1, 2, 4, n of respective columns. An emitter of the input side transistor Qa is grounded through a series circuit of a resistor Ra and an N channel MOS FET Tra having a gate connected to the power source line +VDD.

The D/A converter circuit 2 receives at the input terminals D0 to Dn-1 thereof digital display data corresponding to display luminance, which may vary time to time, from a processor such as a CPU or an MPU, etc., and generates at the output terminal 2*b* analog current values corresponding to the input data (display data). It should be noted that the output circuit of the reference current distribution circuit for one of terminal pins of the drive stage is shown in FIG. 6 as the constant current source 14*a*. Further, a transistor Trr and a transistor Qr constitute a base current supply circuit for supplying a base current to the current-mirror connected common base line and the transistor Qr has an emitter grounded through a series circuit of a resistor Rr and an N channel MOS FET Trra and a gate connected to the power source line +VDD.

There is a recent tendency that the number of drive pins is increasing due to increase of resolution. Since the peak current generator circuit and the D/A converter circuit are provided correspondingly to each of terminal pins for current driving the organic EL elements, the size of integrated circuit is increasing. Therefore, in order to reduce power consumption and reduce the area occupied by the integrated circuit, which is increased with increase of the number of drive pins, it is important to reduce the size of these circuits.

SUMMARY OF THE INVENTION

An object of the present invention is to provide an organic EL drive circuit capable of easily generating a peak current for current driving an organic EL element and of reducing an area occupied by the drive circuit and an organic EL display device using the same organic EL drive circuit.

In order to achieve the above object, a first aspect of the present invention resides in an organic EL drive circuit including a current mirror circuit, which, in response to a predetermined current supplied to an input side transistor portion thereof, generates a predetermined current to be supplied to a terminal pin of an organic EL panel in an output side transistor portion thereof or a current on which the predetermined current is obtained, is featured by that the input side transistor portion includes a plurality of parallel-connected input side transistors and a control circuit for controlling an output current of the output side transistor such that the output current is changed from a peak current to a steady current by reducing a drive current for one of the input side transistors with respect to the current mirror circuit by generating the peak current in the output side transistor portion by current-driving one of the input side transistors and branching the predetermined current to the other input side parallel transistors provided in parallel to the one input side transistor current-driven by the predetermined current.

According to a second aspect of the present invention, in the organic EL drive circuit of the first aspect, the output side transistor portion of the current mirror circuit includes a plurality of output side transistors and a D/A converter circuit is constructed with the plurality of the output side transistors and generates a total value of currents flowing through the output side transistors at its output terminals by making each of the output side transistors correspondent to bit column position of an input data to be D/A converted and selectively operating the output side transistors correspondingly to the input data. A switch circuit is provided in at least one of the input side transistors of the current mirror circuit and a constant current source for generating the predetermined current is provided. The organic EL drive circuit generates a converted analog current having the peak by reducing a drive current for one of the input side transistors of the current mirror circuit by supplying a current from the constant current source to one of the input side transistors to drive the one input side transistor and turning the switch circuit ON at a predetermined time from the drive start time to branch the current from the constant current source through the switch circuit.

According to a third aspect of the present invention, in the organic EL drive circuit of the second aspect, the current mirror circuit includes two input side transistors having operating current ratio of 1:N where N>1, wherein one of the input side transistors having operating current ratio of 1 is supplied with current from the constant current source and supplies a branch current to the other input side transistor corresponding to the operating current ratio of N by turning the switch circuit ON.

As mentioned above, according to the present invention, a plurality of parallel-connected input side transistors of the current mirror circuit are provided and the input side drive current is controlled by inserting the switch circuit in series with one of the input side transistors. A current corresponding to the peak current of the output side transistor is generated by the input side transistor, which is driven first, and the drive current of each of the input side transistors of the current mirror circuit is reduced by branching the drive current to one of the input side transistors by turning the switch circuit ON after a predetermined time from a drive start time by driving one of said input side transistors with the predetermined current, or from the generation of the current of the output side transistor portion or from a drive start time of an organic EL element. Therefore, a large drive current flows at the start time so that a current corresponding to the peak current is obtained by the output side transistor of the current mirror circuit and, after the predetermined time therefrom, the drive current smaller than the initial drive current flows to make the output current of the output side transistor becomes steady current, resulting in that the current having the peak is generated in the output side transistor.

Therefore, the insertion of a resistor in the output stage circuit and the switch circuit for short-circuiting the resistor (corresponding to the switching element 8 shown in FIG. 5), which are necessary in the conventional technology, become unnecessary. Further, the conventional drive current source (corresponding to the drive stage current mirror circuit 3*a* shown in FIG. 6) dedicated to the peak current generation for adding the peak current becomes unnecessary. Therefore, according to the present invention, the circuit construction of the organic EL panel becomes simple.

As a result, it is easy to generate a drive current having a peak necessary to initially driving the organic EL element and to reduce the area occupied by the drive circuit.

BRIEF DESCRIPTION OF THE DRAWINGS

FIG. 2 shows timing pulses used in a drive control of the current drive circuit shown in FIG. 1;

FIG. 3(*b*) is a block diagram of an output stage of the current drive circuit thereof;

FIG. 5 shows an example of a conventional column drive circuit; and

DESCRIPTION OF THE PREFERRED EMBODIMENTS

Figure 1:
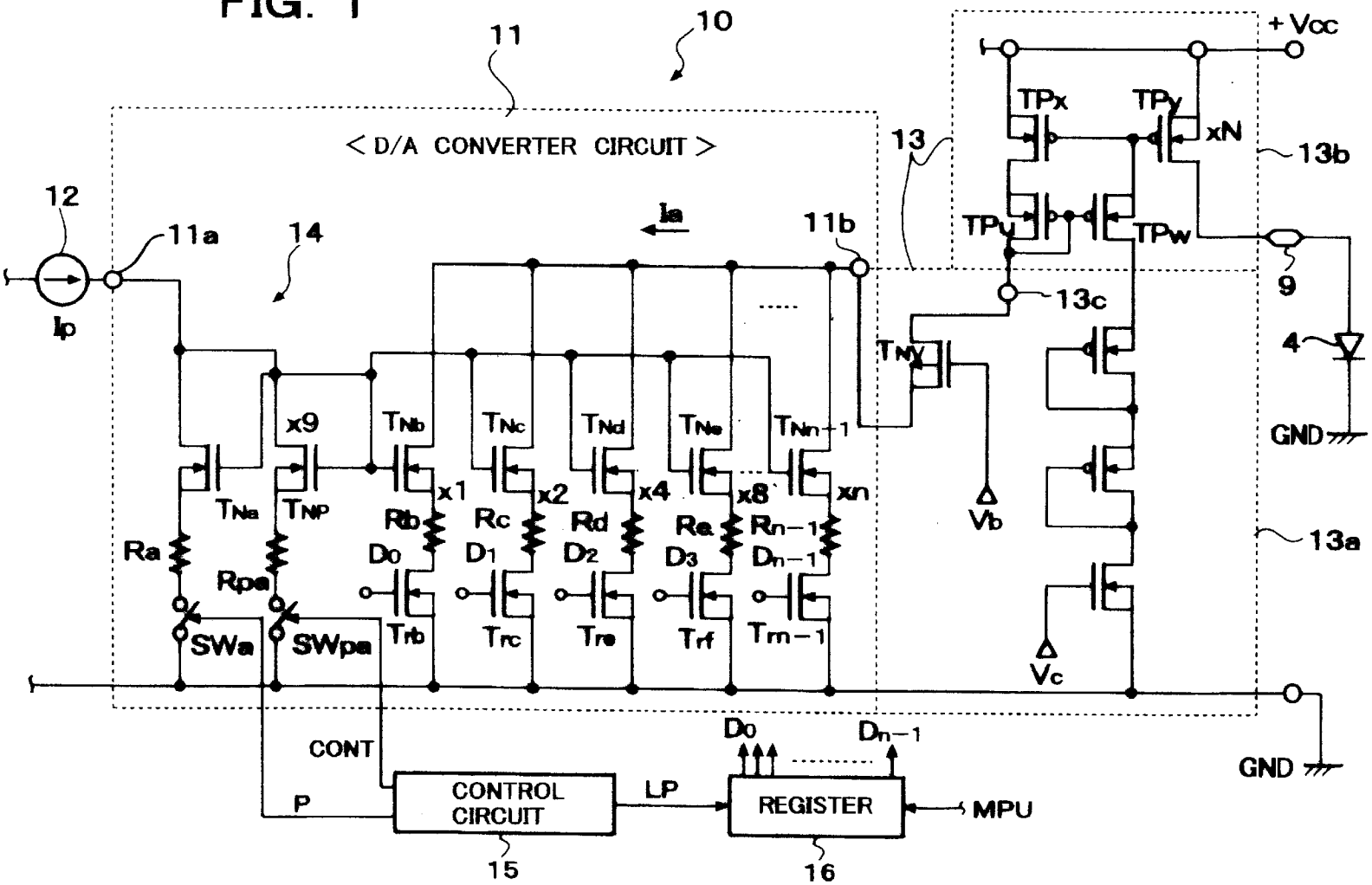
FIG. 1 is a block diagram of a current drive circuit of an organic EL drive circuit according to an embodiment of the present invention.
Figure 6:
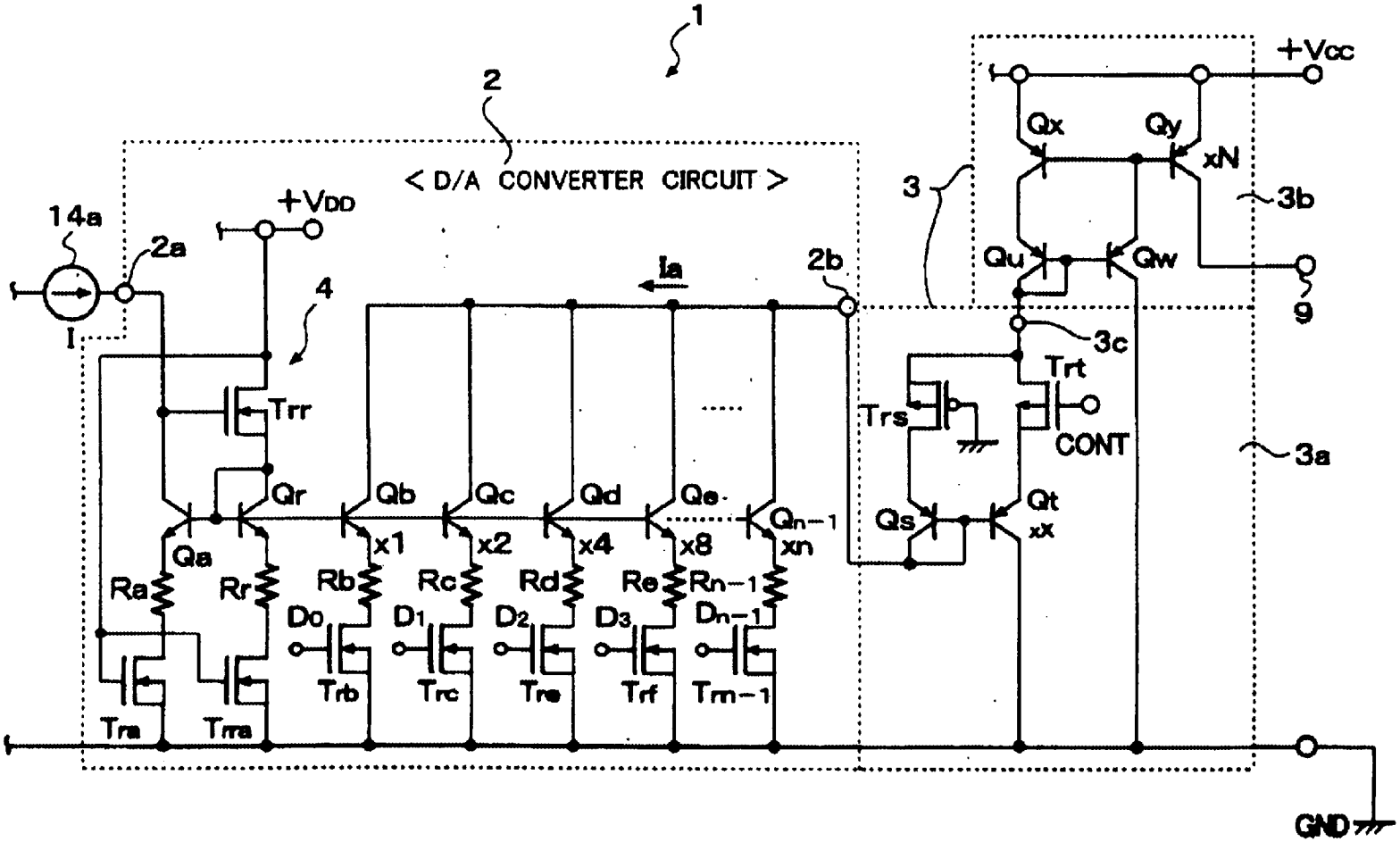
FIG. 6 is a circuit diagram of a prior art D/A converter circuit of an organic EL drive circuit.

In FIG. 1, a current drive circuit according to the present invention includes a column driver 10 of an organic EL drive circuit, a D/A converter circuit 11 of the column driver 10, a constant current source 12, which is an output circuit of a reference current distribution circuit, which corresponds to one terminal pin and corresponds to a constant current source 14*a* shown in FIG. 6, a current mirror type current output circuit 13, a peak current generator circuit 14 and a control circuit 15.

The D/A converter circuit 11 corresponds to the D/A converter circuit 2 shown in FIG. 6. However, the D/A converter circuit 11 shown in FIG. 1 is constructed with not bipolar transistors but MOS FETs. An N channel transistor TNa on an input side corresponds to an input side transistor Qa of the D/A converter circuit 2 and N channel transistors TNb to TNn-1 on an output side correspond to the output side transistors Qb to Qn-1 and the N channel transistors TNa and TNb to TNn-1 constitute a current mirror circuit portion. The D/A converter circuit 11 further includes an N channel transistor TNp on the input side, which is connected in parallel to the input side transistor TNa. Channel width (gate width) ratio of the transistors TNa and TNp is set to 1:9 and sources of these transistors are grounded through resistors Ra and Rpa and switch circuits SWa and SWpa, respectively.

The channel width (gate width) ratio of 1:9 of the transistors TNa and TNp may be provided by connecting 9 identical MOS transistors in parallel to one identical MOS transistor.

The input side transistors TNa and TNp have drains supplied with current Ip from the constant current source 12 through an input terminal 11*a*. Unlike the constant current source 14*a* shown in FIG. 6, a current value of the constant current source 12 is Ip, which is larger than the current value I of the constant current source 14*a*. The current value Ip is set such that, when the current Ip flows through the input transistor TNa as its operating current, a peak current Ia=Ipa is generated at an output terminal 11*b* of the D/A converter circuit 11.

Incidentally, the resistors Rb to Rn-1 are inserted between sources of the output side transistors TNb to TNn-10 and drains of the transistors Trb to Trn-1, respectively. Although it is possible to maintain a predetermined time constant due to parasitic capacitance between source and drain by these resistors, they are not always necessary. Further, it should be noted that a base current supply circuit corresponding to the transistor Trr and Qr shown in FIG. 6 is removed.

The current mirror type current output circuit 13 corresponds to the current mirror circuit 3 shown in FIG. 6. However, the current mirror type current output circuit 13 is constructed with not bipolar transistors but MOS FETs and includes a drive level shift circuit 13*a* and an output stage current mirror circuit 13*b*. There is no peak current generator circuit corresponding to the current mirror circuit 3*a* shown in FIG. 6.

The drive level shift circuit 13*a* functions to transmit an output of the D/A converter circuit 11 to the output stage current mirror circuit 13*b* and is constructed with an N channel MOS FET TNv having a gate connected to a bias line Vb, a source connected to the output terminal 11*b* of the D/A converter circuit 11 and a drain connected to an input terminal 13*c* of the output stage current mirror circuit 13*b*.

Therefore, assuming that the output current of the D/A converter circuit 11 is Ia, it is possible to generate a drive current Ia at the input terminal 13*c* of the output stage current mirror circuit 13*b*.

The output stage current mirror circuit 13*b* includes P channel MOS FETs TPu and TPw, which correspond to the transistors Qu and Qw of the base current correcting current mirror shown in FIG. 6, respectively, and P channel MOS FETs TPx and TPy, which correspond to the transistors Qx and Qy of the current mirror shown in FIG. 6, respectively.

The channel width (gate width) ratio of the transistors TPx and TPy of the output side current mirror circuit 13*b* is 1:N where N>1 and the sources of these transistors are connected to not the power source line +VDD but the power source line +Vcc, which is, for example, about +15V higher than the voltage of the power source line +VDD. The output of the output side transistor TPy is connected to the column side pin 9 to current drive the organic EL panel by supplying the drive current N Ia to the column side pin 9 during the drive of the organic EL panel. The organic EL element 4 is connected between the column side pin 9 and ground GND. In FIG. 1, Vc represents a bias line.

The input side transistor TNp, the resistor Rpa and the switch circuit SWpa constitute the peak current generator circuit 14. The switch circuit SWa is turned ON by a drive pulse signal P and the switch circuit SWpa is kept OFF until the control signal CONT generated after a constant time tp from the generation of the drive pulse signal P is supplied and, thereafter, it is turned ON.

Describing the peak current generation with reference to FIG. 2, when data inputted from an MPU, etc., which are to be supplied to the respective input terminals D0 to Dn-1, are registered in a register 16 according to latch pulse Lp from the control circuit 15 controlled by an MPU, the data are set in the respective input terminals D0 to Dn-1. The control circuit 15 generates the drive pulse signal P to turn the switch circuit SWa ON after the latch pulse Lp is sent to the register 16. Since, in this case, the control signal CONT is not supplied to the switch circuit SWpa, the current Ip flows to the input side transistor TNa. Therefore, the D/A converter circuit 11 generates a current value m Ip where m corresponds to the data set in one of the input terminals D0 to Dn-1 to generate the peak current Ia=m Ip at its output terminal 11*b*. When the switch circuit SWpa is turned ON by the control signal CONT generated after the peak current generation period tp, the current flowing in the input side transistor TNa is branched to the input side transistor TNp. Therefore, a current Ip/10 and a current 9 Ip/10 flow to the input side transistors TNa and TNp according to the channel width ratio 1:9 of these transistors. Since the transistors TNa and TNp are connected in parallel and the channel width ratio thereof is 1:9, the current amplification of the output side transistor becomes 1/9 even when the current 9 Ip/10 flows in the input side transistor TNp. Therefore, this situation for the respective output side transistors is the same as that the drive currents Ip/10 flow in the respective input side transistors.

That is, since the input side transistors TNa and TNp are driven in parallel, the mirror current generated on the output side is the same as that the input side drive current becomes Ip/10, so that the current value Ta becomes m Ip/10. This current becomes the drive current of the input side transistors in the steady state and the current Ip/10 flows during a remaining period (T-tp) for which the drive pulse signal P is maintained in high "H" level. The drive pulse signal P and the control signal CONT become low "L" level after the period (T-tp) from the generation of the control signal CONT, so that the switch circuits SWa and SWpa are turned OFF and the drive currents of the input side transistors TNa and TNp are removed.

As described, the peak current generator circuit 14 operates to obtain the peak current in the output side transistors of the current mirror circuit by driving the input side transistor TNa and to reduce the drive current for each of the input side transistors of the current mirror circuit by branching the drive current of the input side transistor TNa to the other input side transistor TNp connected in parallel to the transistor TNa to thereby drop the peak current to the steady current. The drive start time of the input side transistor TNa corresponds to the drive start time of the organic EL element 4.

The current of the input side transistor TPx of the output stage current mirror circuit 13*b* during the period for which the switch circuit SWpa, that is, the transistor TNp, is in OFF state, that is, the constant period tp for which the peak current is generated, becomes Ia=m Ip, that is, 10 times the steady current. And then, the drive current Ia=Ip/10 is outputted as the steady drive current. The current is multiplied by N by the output stage current mirror circuit 13*b* and supplied to the corresponding terminal pin 9 of the organic EL panel.

Incidentally, the start time of the peak current period tp is not always coincident with the rising time of the drive pulse signal P since it is enough to initially charge the organic EL element 4 having the capacitive load characteristics by the peak current.

In the organic EL display device, the column side becomes the current discharge side and the row side becomes a current sink side, so that the drive current of the column side current drive circuit is outputted correspondingly to a scan on the row side. Therefore, although the organic EL element 4 shown in FIG. 1 or FIG. 6 is connected between the terminal pin 9 and ground GND, it is practical that the organic EL element 4 is grounded through a row line scan circuit.

The scan of the row side by the row line scan circuit is performed by grounding a cathode of the organic EL element 4 by making the row line to be scanned in L level. That is, when the cathode is grounded, a drive current flows to the organic EL element 4 and there is a H period in which the column side drive current is turned OFF in the switching period for which a scan of a certain row line is switched to a next row line. In such row side scan, the drive pulse signal P for providing the drive current is unnecessary. Instead thereof, the scan start time of a certain row line of the column driver 10 becomes a start time of the current drive for the pins 9 and an end of the scan of that row line becomes an end of the drive current. Therefore, the drive operation corresponding to the above mentioned drive pulse signal P is performed in performed in the scan on the row side. Consequently, the switch circuit SWa becomes unnecessary in a practical circuit. For this reason, the switch circuit SWa in a circuit shown in FIG. 4 to be described later is deleted.

Figure 3A:
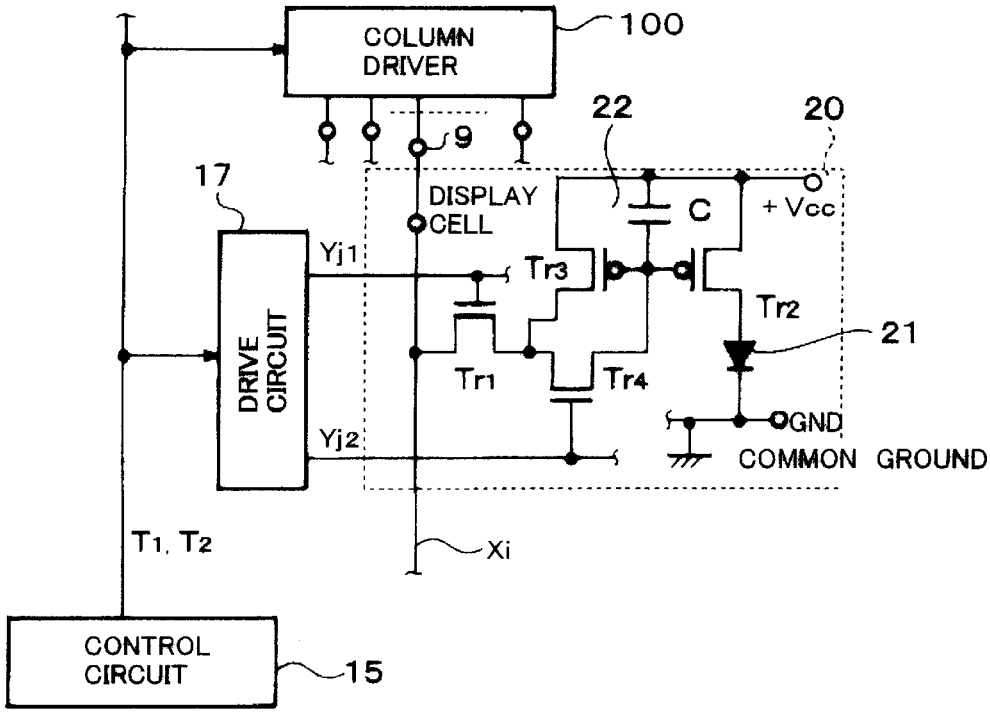
FIG. 3(*a*) is a circuit diagram of the current drive circuit of the present invention when it is applied to an active matrix type organic EL display panel.
Figure 3B:
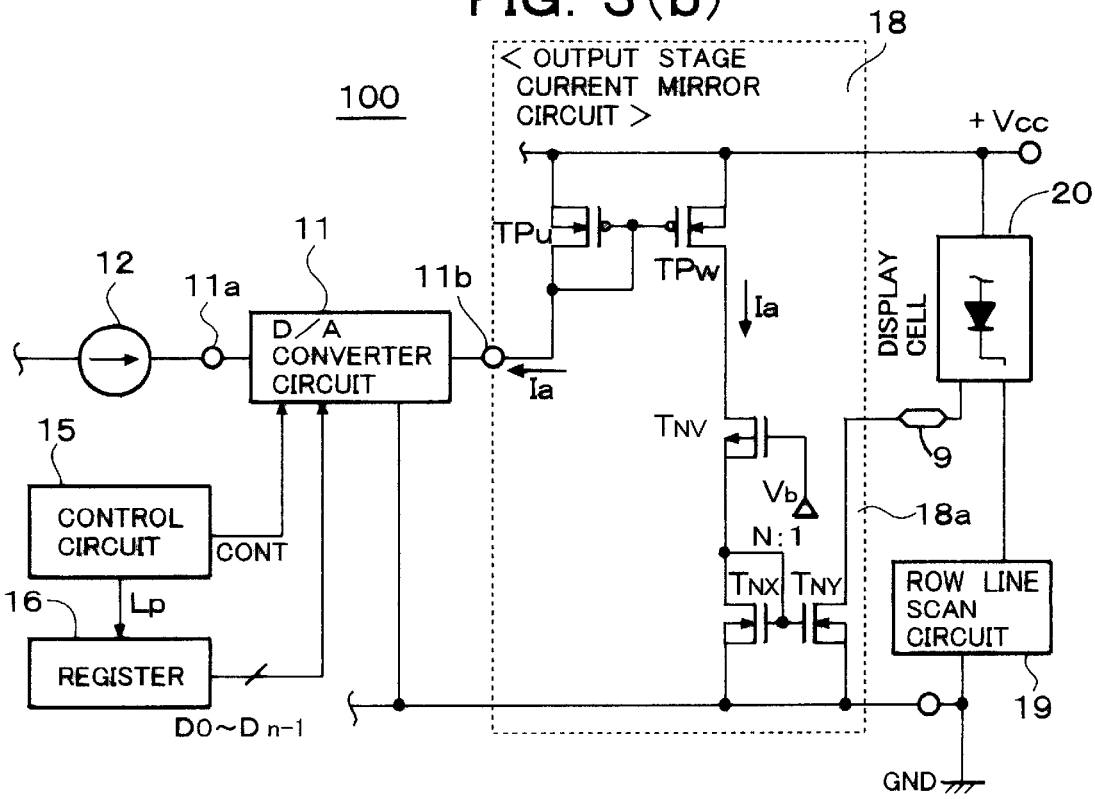

FIG. 3(*a*) shows an embodiment of the present invention in which the organic EL display panel is of the active matrix type.

In FIG. 3(*a*), a column driver 100 of the active matrix type organic EL drive circuit is different from the column driver 10 shown in FIG. 1 in that a current sink type output stage current mirror circuit is used. An example of a circuit construction of the current sink type output stage current mirror circuit is shown in FIG. 3(*b*).

One of terminal pins 9 of the column driver 100 to which an output current mirror circuit 101 is connected is connected to one (Xi) of n data lines among a X-Y matrix wiring (data lines and scan lines) of the active matrix type, where i=1~n.

As shown in FIG. 3(*a*), a display cell 20 is provided at a position (Xi, Yj) corresponding to a cross point of the data line Xi and scan lines Yj1 and Yj2. Within the display cell 20, an N channel MOS transistor Tr1 having a gate connected to the scan line Yj1 and a source connected to the data line Xi is provided and an organic EL element 21 is driven through a P channel MOS transistor Tr2. A capacitor C is connected between a source and a gate of the transistor Tr2 and the source of the transistor Tr2 is connected to a power source line +Vcc and a drain thereof is grounded through the organic EL element 21.

A P channel MOS transistor Tr3 and an N channel MOS transistor Tr4 are provided between the transistors Tr1 and Tr2. The transistor Tr3 is an input side transistor of a current mirror circuit 22 constructed with it and the transistor Tr2 and the drain of the transistor Tr1 is connected to a downstream side of the transistor Tr3. A source and a drain of the transistor Tr4 are connected between a connection point of the transistors Tr3 and Tr1 and commonly connected gates of transistors Tr3 and Tr2 of the current mirror circuit 22. The gate of the transistor Tr1 is connected to the scan line Yj1 and the gate of the transistor Tr4 is connected to the scan line Yj2.

The transistors Tr1 and Tr4 are turned ON by H level signals on the scan lines Yj1 and Yj2, so that the transistors Tr3 and Tr2 are driven by the peak current and, simultaneously, the capacitor C is charged to a predetermined drive voltage. Thus, the capacitor C stores the drive current value as a predetermined voltage and the MOS transistor Tr2 is driven by the voltage of the capacitor C.

In this case, charge written in the capacitor C is discharged through the transistors Tr4 and Tr3 as diodes, resetting the voltage of the capacitor C, when the signals on the scan lines Yj1 and Yj2 become L and H, respectively, and the transistor Tr4 is turned ON by H signal on only the scan line Yj2. Incidentally, the scan of the scan lines Yj1 and Yj2 is performed by the drive circuit 17 upon different timing signals T1 and T2 from the control circuit 15.

FIG. 3(*b*) is a block circuit diagram of the output stage of the current drive circuit 18 together with a constant current source 12 and a D/A converter circuit 11, which are shown in FIG. 1.

In FIG. 3(*b*), instead of the P channel MOS FETs TPx and TPy of the output stage current mirror circuit 13*b* shown in FIG. 1, the current mirror output stage circuit includes the current mirror circuit 18*a* having N channel MOS FETs TNx and TNy and provided on a downstream side of the transistors TPu and TPw of the output stage current mirror circuit 13*b*. With such circuit construction, it is possible to generate a drive current, which is sunk with respect to the terminal pin 9.

Sources of the transistors TNx and TNy are grounded. A drain of the transistor TNx is connected to a drain of a transistor TPw through a transistor TNv and a drain of the transistor TNy is connected to the terminal pin 9. The channel width ratio of the transistors TNx and TNy is not 1:N in the case shown in FIG. 1 but N:1, where N is about 10. Similarly to the case shown in FIG. 1, the transistor TNv is used for level regulation.

In FIG. 3(*b*), the current mirror transistors TPu and TPw have sources directly connected to the power source line +Vcc and converts the drive current sunk by the D/A converter circuit 11 into a discharge current by turning the drive current back from the power source line +Vcc.

The transistor TNx is driven by the discharge current to generate the drive current sunk by the transistors TNx and TNy.

In the current drive circuit having the output stage of the current drive circuit 18, the cathode of the organic EL element 21 is connected to the row line scan circuit 19 hrough the data line Xi and grounded by the scan circuit 19.

The current drive of the active matrix type organic EL display panel is effective in a case where the rising time of the current is not negligible with respect to a drive duty cycle. That is, the current drive of the active matrix type organic EL display panel is effectively used for a drive of a large scale, high definition image quality display panel of such as an SGA or an XGA, which has a large number of drive data lines driven with small drive current.

Figure 4:
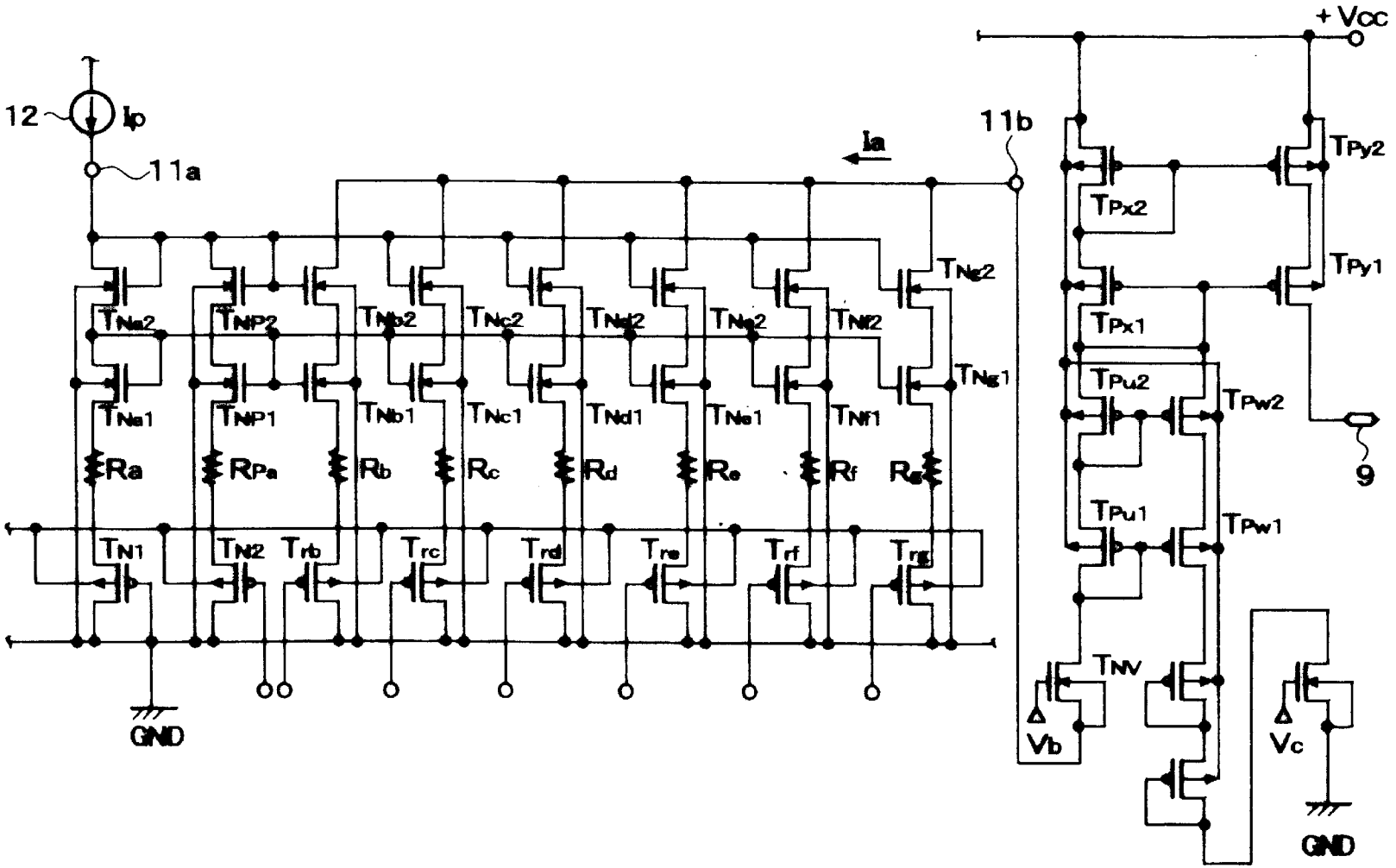
FIG. 4 shows a detailed circuit construction of the embodiment shown in FIG. 1.

FIG. 4 is a detailed circuit construction of the embodiment shown in FIG. 1. The input side transistor TNa includes a pair of series-connected transistors TNa1 and TNa2 and each of the output side transistors TNb to TNn-1 includes a pair of series connected transistors with suffix numbers 1 and 2. These series-connected transistors are connected between the power source line and ground GND. The switch circuit SWpa is constructed with a MOS FET TN2. A current mirror circuit is piled up on the input side transistor TPx and the output side transistor TPy of the output stage current mirror circuit 13*b*.

That is, in the output stage current mirror circuit 13*b*, the current mirror circuit including the transistors TPu and TPw is constructed by piling up two current mirror circuits one of which includes P channel MOS FETs TPu1 and TPw1 and the other of which includes P channel MOS FETs TPu2 and TPw2. Further, the current mirror circuit including the transistors TPx and TPy is constructed by piling up two current mirror circuits one of which includes P channel MOS FETs TPx1 and TPy1 and the other of which includes P channel MOS FETs TPx2 and TPy2.

In FIG. 4, the MOS FET TN1 provided in the position of the switch circuit SWa is not a switch circuit. The MOS transistor TN1 has a gate grounded and functions as a resistor. That is, the switch circuit SWa is removed. As a result, the constant current Ip from the constant current source 12 always flows through the MOS FET TN1. This is because the row side scan circuit performs a drive operation corresponding to the drive pulse P as described previously.

Unlike FIG. 1, the transistors Trb to Trn-1 shown in FIG. 4 are P channel MOS transistors. By using the P channel MOS transistors as the transistors Trb to Trn-1, an output impedance of each of the transistors Trb to Trn-1 is lowered, so that switching noise generated when the display data is set in the D/A converter circuit can be reduced.

Although the peak current generator circuit has been described with reference to the current switching D/A converter circuit constructed with the current mirror circuits, the present invention is not limited to the current mirror circuit of such D/A converter circuit. The current mirror circuit may be provided in any portion of the current drive circuit, provided that a drive current flowing to the terminal pin of the organic EL panel or a current from which the drive current is generated can be obtained by the current mirror circuit.

Further, although the current mirror circuit according to the present invention includes MOS FETs mainly, it may be constructed with bipolar transistors since it is easily possible in designing the circuit to provide the bipolar transistors in the positions of the MOS transistors as will be clear from the circuit constructions shown in FIG. 6 and FIG. 1. Further, it is possible to substitute P channel (or PNP) type transistors for the N channel type (or NPN type) transistors and to substitute N channel type (or NPN type) transistors for the P channel type (or PNP type) transistors. In the latter case, the power source voltage is negative and the transistors provided in the upstream side are provided in the downstream side.

What is claimed is:

1. An organic EL drive circuit in which a current mirror circuit having an input side transistor portion supplied with a predetermined current generates in an output side transistor portion thereof a current supplied to a terminal pin of an organic EL display panel or a reference current from which the current is derived, comprising:

a plurality of parallel connected input side transistors provided in said input side transistor portion; and a control circuit for driving one of said input side transistors with a predetermined current to generate a peak current in said output side transistor portion and reducing the peak current in said output side transistor portion to a steady current by branching the predetermined current in said one input side transistor to the other input side transistors parallel to said one input side transistor.

2. The organic EL drive circuit as claimed in claim 1, further comprising a switch circuit portion connected in series with at least one of said input side transistors and a current source for generating the predetermined current, wherein said control circuit drives one of said input side transistors with a current from said current source to turn said switch circuit portion ON after a predetermined time from a drive start time.

3. The organic EL drive circuit as claimed in claim 2, wherein said input side transistor portion includes two input side transistors having an operating current ratio 1:N where N>1 and said switch circuit portion turned ON after the predetermined time from the drive start time is inserted into one of said two input side transistor having operating current ratio N.

4. The organic EL drive circuit as claimed in claim 2, wherein said switch circuit portion includes a plurality of switch circuits inserted in series with the plurality of said input side transistors, respectively, and said control circuit drives at least one of the plurality of said switch circuits with the current from said constant current source by turning at least one of said switch circuits ON and branches the current from said constant current source to at least one of said input side transistors by turning at least one of the remaining switch circuits ON after the predetermined time from a drive start time by driving one of said input side transistors with the predetermined current from said current source.

5. The organic EL drive circuit as claimed in claim 4, wherein said input side transistor portion includes two input side transistors having an operating current ratio 1:N where N>1 and said switch circuit portion turned ON after the predetermined time is inserted into one of said two input side transistor having operating current ratio N.

6. The organic EL drive circuit as claimed in claim 3, further comprising a current mirror output circuit for outputting a current to a terminal pin of said organic EL display panel, wherein said current mirror circuit constitutes a D/A converter circuit, said current source is a constant current source and said current mirror circuit drives said current mirror output circuit with the output current of an output side transistor of said D/A converter circuit.

7. The organic EL drive circuit as claimed in claim 6, wherein the predetermined time is measured from a drive start time of an organic EL element and corresponds to a time for which said organic EL element is initially charged by the peak current.

8. The organic EL drive circuit as claimed in claim 7, wherein said constant current source is an output circuit corresponding to one of said terminal pins of a circuit for distributing a reference current correspondingly to said terminal pins and said switch circuit is provided on a downstream side of said input side transistor.

9. An organic EL drive circuit including a D/A converter circuit which has a current mirror circuit having a plurality of output side transistors connected in parallel in current mirror manner and an input side transistor portion supplied with a predetermined current, said output side transistors corresponding to bit positions of input data, respectively, and selectively operating according to the input data, and said D/A converter circuit generating at an output terminal thereof converted analog current corresponding to the input data as a total current of said output side transistors, said organic EL drive circuit comprising:

a plurality of parallel connected input side transistors provided in said input side transistor portion;

a plurality of switch circuits connected in series with said input side transistors, respectively, a current source for driving said input side transistors with a predetermined constant current; and a control circuit for ON-OFF controlling said switch circuits, said control circuit reducing a drive current of one of said input side transistors by turning at least one of said switch circuits ON to drive said one of said input side transistors with said predetermined constant current and turning at least one of the remaining switch circuits ON after a predetermined time from a drive start time to branch the constant current to at least one of said input transistors to thereby generate the converted analog current having a peak current in said output side transistor portion.

10. The organic EL drive circuit as claimed in claim 9, wherein said input side transistor portion includes two input side transistors having an operating current ratio 1:N where N>1 and said switch circuit portion turned ON after the predetermined time is inserted into one of said two input side transistors having operating current ratio N.

11. The organic EL drive circuit as claimed in claim 10, further comprising a current mirror output circuit for outputting a current to a terminal pin of an organic EL panel, wherein the input data is display data, the other of said two input side transistors having operating current ratio 1 is directly driven with the predetermined constant current and the converted analog current is used as a drive current of said current mirror output circuit.

12. An organic EL drive circuit having a current mirror circuit responsive to a predetermined current to input side transistors for generating a current to be supplied to a terminal pin of an organic EL panel or a basic current from which the currents are obtained in output side transistors, said organic EL drive circuit comprising:

a first input side transistor and a second input side transistor connected in parallel to the first input side transistor;

a switch circuit connected in series with said second input side transistor;

a constant current source for driving said first input side transistor with a predetermined current; and a control circuit for ON-OFF controlling said switch circuit, wherein said first input side transistor is driven by the constant current and a current having a peak is generated in said output side transistors by reducing the drive current for each of said current mirror circuit by branching a constant current value of the predetermined current to said second input side transistor by turning said switch circuit ON after a predetermined time from a drive start time.

13. The organic EL drive circuit as claimed in claim 12, wherein an operating current ratio of said first and second input side transistors is 1:N, where N>1.

14. The organic EL drive circuit as claimed in claim 13, wherein said constant current source is an output circuit responsive to a reference current for outputting a current to one of said terminal pins of a circuit for distributing the reference current and said switch circuit is provided a downstream side of said input side transistors.

15. An organic EL display device comprising:

an organic EL display panel;

a current mirror output circuit for outputting currents to terminal pins of said organic EL display panel;

a D/A converter circuit having a current mirror circuit including a plurality of parallel input side transistors supplied with a predetermined current and a plurality of parallel output side transistors, said output side transistors corresponding to respective bit positions of display data and selectively operating according to the display data, said D/A converter circuit converting the display data into analog current to generate the analog current as a total of currents of said output side transistors; and a control circuit for driving one of said input side transistors with a predetermined current to generate a peak current in said output side transistors and reducing the peak current in said output side transistors to a steady current by branching the predetermined current in said one input side transistor to the other input side transistors parallel to said one input side transistor.

16. The organic EL display device as claimed in claim 15, further comprising a switch circuit connected in series with at least one of said input side transistors and a constant current source for generating the predetermined current, wherein said control circuit turns said switch circuit ON after a predetermined time from a drive start time by driving one of said input side transistors with the predetermined current from said current source.

17. The organic EL display device as claimed in claim 16, wherein the plurality of said input side transistors includes two transistors having an operating current ratio 1:N where N>1 and said switch circuit portion turned ON after the predetermined time is inserted into one of said two input side transistor having operating current ratio N.

18. The organic EL display device as claimed in claim 16, wherein said switch circuit includes a plurality of switch circuits inserted in series with the plurality of said input side transistors, respectively, and said control circuit drives at least one of the plurality of said switch circuits with the current from said constant current source by turning at least one of said switch circuits ON and branches the current from said constant current source to at least one of said input side transistors by turning at least one of the remaining switch circuits ON after a predetermined time from the drive start time.

19. The organic EL drive circuit as claimed in claim 15, wherein outputs of said current mirror output circuits generate charge current for a voltage memory capacitor provided in active matrix type display cells.

20. The organic EL display device as claimed in claim 19, wherein each of said display cells includes a current mirror circuit, commonly connected gates or bases of said current mirror circuits are connected to said capacitors, respectively, organic EL elements are connected to output sides of said current mirror circuit of said display cell, first transistors for driving said input side transistors of said current mirror circuit of said cell are provided between data lines and scan lines, connecting points between input side transistors of said cell and second transistors and said commonly connected gates or bases of said current mirror circuits in said cell are connected through said second transistors and said capacitors are reset by turning said second transistors ON.

21. The organic EL display device as claimed in claim 20, wherein said current mirror current output circuit sinks current from said data line.

22. An organic EL display device comprising:

an organic EL display panel;

a current mirror output circuit for outputting currents to terminal pins of said organic EL display panel;

a D/A converter circuit having a current mirror circuit including a plurality of parallel input side transistors supplied with a predetermined current and a plurality of parallel output side transistors, said output side transistors corresponding to respective bit positions of display data and selectively operating according to the display data, said D/A converter circuit converting the display data into analog current to generate the analog current as a total of currents of said output side transistors;

switch circuits connected in series with said second input side transistors;

a constant current source for driving said first input side transistor with a predetermined constant current; and a control circuit for ON-OFF controlling said switch circuit, wherein said first input side transistors are driven by the constant current and a current having a peak is generated in said output side transistors by reducing the drive current for each of said current mirror circuits by branching the constant current to said second input side transistors by turning said switch circuits ON after a predetermined time from a drive start time.

* * * * *